United States Patent [19]

Skipworth

[11] 4,432,278

[45] Feb. 21, 1984

[54] CAN CRUSHING APPARATUS

[75] Inventor: Walter J. Skipworth, Ashley, Ohio

[73] Assignee: Glassco, Inc., Ashley, Ohio

[21] Appl. No.: 360,831

[22] Filed: Mar. 23, 1982

[51] Int. Cl.[3] ..... B30B 9/32; B30B 3/04

[52] U.S. Cl. ..... 100/53; 100/158 C; 100/902

[58] Field of Search ..... 100/158 C, 902, 53; 241/99, 252

[56] References Cited

U.S. PATENT DOCUMENTS

| | | | |
|---|---|---|---|
| 2,356,122 | 8/1944 | Edwards | 100/158 C |
| 2,789,618 | 4/1957 | Bennett | 100/902 X |
| 2,945,431 | 7/1960 | Wehr | 100/158 C X |
| 3,322,355 | 5/1967 | Bryant | 241/99 X |
| 4,084,496 | 4/1978 | Ehernberger | 100/158 C X |

*Primary Examiner*—Billy J. Wilhite

*Attorney, Agent, or Firm*—Mueller and Smith

[57] ABSTRACT

Can crushing apparatus wherein mutually angularly disposed convex and flat conical disks are rotated to define an open, wedge-shaped receiving region which progressively diminishes about a circular locus to an exit position of close adjacency of the surfaces. Cans are introduced into the receiving region whereupon they are progressively longitudinally flattened, thus facilitating the expulsion of any liquids remaining within the cans while carrying out flattening. By introducing cans from an upwardly disposed trough structure, inherent safety is achieved such that the operator cannot reach into the crushing components of the apparatus. The slope of the disk member engaging surfaces preferably is about 9°, while the included angle therebetween at the receiving region preferably is about 33°. By operating the disks at about 60 rpm, improved silent operation is achieved.

13 Claims, 6 Drawing Figures

CAN CRUSHING APPARATUS

BACKGROUND

The widespread acceptance of disposable aluminum containers or cans by the international beverage market has developed a secondary industry devoted to the recovery of the aluminum contents of disposed cans. Various approaches to this recovery have been undertaken, for example commercial municipal waste treatment companies have found it profitable to employ "pickers" to remove the cans as they pass along inspection conveyors. Similarly, volunteer non-profit organizations have been observed to establish community collection points and the like for the cans whereupon they are delivered and sold to reprocessors. A growing interest in developing, however, on the part of commercial food and beverage service entities such as restaurants and bars, the operators of which now find it profitable to recover cans used in their business for sale ultimately to aluminum production entities.

Because the used cans are light and in larger numbers represent a very large volume, they must be crushed prior to shipment to aluminum processors. Generally, those can crushing devices which have been available have been of a variety employed by larger waste treatment facilities and usually are constituted as large, highly powered machines representing a significant capital investment. However, the need for an effective crushing device has expanded to the above-noted food and beverage service field and, in this regard, a need has arisen for a crushing device which is counter-mounted and may be used by service establishment employees. For the most part, the relatively small crushers currently employed for such use have resembled home trash compactors wherein a door on the compactor is opened, the cans are deposited therein, the door is closed, a button is pushed, and a jack screw driven element is actuated to crush the deposited cans. As is apparent, the use of such devices is somewhat labor intensive, requiring several movements on the part of the employee and necessitating a relatively extended interval of time to carry out the actual crushing procedure. Further, such screw driven machines are undesirably noisey and their cost is relatively high. In the latter regard, statistically some of the cans will be partially or totally full of beverage, thus, the compactor type crusher devices must have an enhanced power capability, inasmuch as the compression required to crush liquid containing cans is quite considerable.

Of course, with all such devices, ergometric or human factor design considerations become important. The structure of the crusher must be such that the human hand or arm cannot possibly be injured by the device. Such ergometric requirements generally have been found to engender higher machine costs and contribute to the earlier noted labor intensive aspects of conventional crushing machines.

SUMMARY

The present invention is addressed to can crushing apparatus which is highly efficient and of relatively low cost. Utilizing mutually angularly disposed convex, flat, conical disks, cans to be crushed are introduced into a receiving region defined thereby and progressively, longitudinally crushed or flattened over an elongate circular path. In consequence of this elongate movement and gradual crushing action, mechanical advantage is achieved and a progressive lengthwise flattening action is developed in treating the cans. Thus cans containing liquid are manipulated in such a fashion that the liquid is expelled by expression through one end thereof in a gradual manner. In consequence, higher compressive requirements as have been required in typical crushing devices are avoided.

As another feature and object of the invention, can crushing apparatus is provided of the type described hereinabove wherein the mechanical manipulation of the mutually disposed disks is one purely of rotation on a continuous basis. By eliminating all reciprocatory machinery requirements as well as movable can positioning components, lower noise levels are achieved while maintaining an advantageous simplicity of design.

As another object of the invention, can crushing apparatus is provided having a support housing with a can receiving opening formed within the surface thereof. First and second disk members each having mutually inwardly facing convex conical engaging surfaces of predetermined slope are provided and each of these disks is rotatable about a corresponding axis of rotation. A disk support arrangement is provided which is mounted within the housing for rotatably supporting the disk members for rotation about their axes. The disk support is such that the axes of the disk members are angularly oriented with respect to each other to locate the engaging surfaces in a manner defining a wedge-shaped can receiving region which is accessible to the can receiving opening. These engaging surfaces further define a continuously diminishing spacing therebetween extending from the can receiving opening to a region of minimum spacing, for example ¼ inch at a crushed can exit location. A motor arrangement is utilized for effecting the rotation of the disk members and a collection arrangement is provided having an opening adjacent the crushed can exit location for receiving crushed cans.

As another feature and object of the invention, apparatus as above described is provided wherein the disk component's conical surface is provided having a predetermined slope of engaging surface of about 9°. Further, the included angle of the engaging surfaces in the vicinity of the receiving region is about 33° and is of such extent as to receive a typically sized can in horizontal fashion within the peripheral limits of the disk members.

As another object of the invention, apparatus is provided as described above wherein the disk members are provided having circular outer peripheries and the disk support arrangement includes an upwardly disposed confining member supported adjacent the disk member peripheries and which extends in arcuate fashion from the can receiving region toward the exit location. Additionally, the supporting arrangement may include an input guide component positioned beneath the can receiving region intermediate the disk components for serving to guide cans into engagement with the engaging surfaces.

As another object of the invention, can crushing apparatus is provided having an upper, trough-like surface retaining the can receiving opening, such surface including a can receiving region upon which cans may be deposited for gravitational movement to and through the opening. From the opening, the cans progress through a chute to the receiving region of the dual-disk member assembly. By limiting the manual positioning of cans to the can receiving region, the operator cannot reach to a position wherein hands would be in danger of injury by the crushing mechanism. To improve further these safety aspects, a barrier arrangement is provided over the trough-shaped upper surface of the apparatus to require that cans be applied to the apparatus from the can receiving region.

Other objects of the invention will, in part, be obvious and will, in part, appear hereinafter. The invention, accordingly, comprises the apparatus possessing the construction, combination of elements and arrangement of parts which are exemplified in the following disclosure.

For a fuller understanding of the nature and objects of the invention, reference should be had to the following Detailed Description taken in conjunction with the accompanying drawings.

DETAILED DESCRIPTION

The beverage cans typically utilized in the beverage and food service industry are formed from aluminum dyed blanks and have a diameter of about 2½ inches and a length which varies somewhat, but is typically about five inches. These cans are enclosed with a top component generally sealed at the upper rim of the aluminum container body. When disposed of, the cans may or may not contain beverage, however, the existence of liquids within them may be anticipated.

Figure 1:
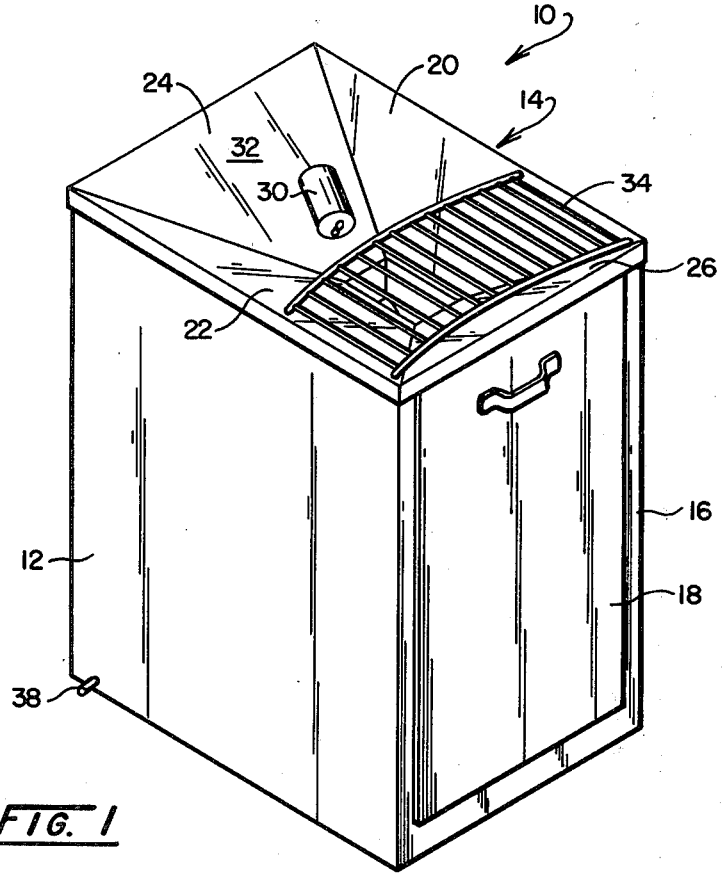
FIG. 1 is a perspective view of can crushing apparatus according to the invention.

Looking to FIG. 1, a perspective representation of a preferred embodiment for can crushers according to the invention is represented generally at 10. Apparatus 10 is shown having an outer support housing of generally rectangular configuration including sidewalls, one of which is revealed at 12, a top surface shown generally at 14 and a front surface 16 which, in turn, supports an access door 18.

Figure 2:
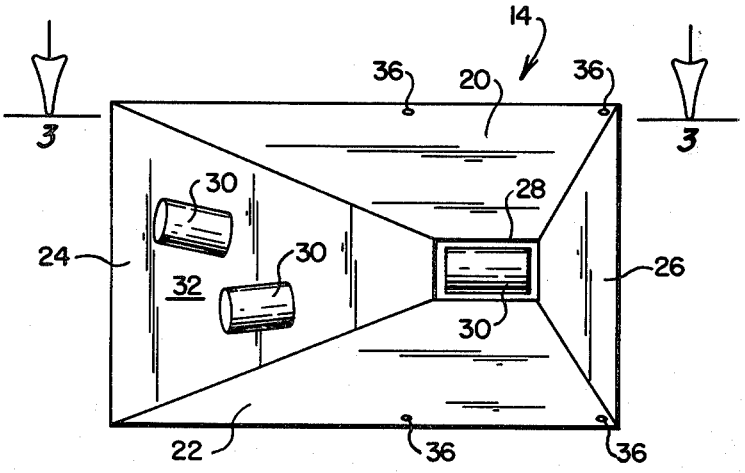
FIG. 2 is a top view of the can crushing apparatus of FIG. 1 with portions thereof removed to facilitate description thereof.

Top surface 14 is shown to be configured somewhat as a trough having downwardly depending sidewalls wherein conjoin with downwardly sloping bottom or feeding surface 24 and bottom surface 26. As shown in FIG. 2, these surfaces meet to form a can receiving opening 28 of rectangular dimension suitable to permit a can as at 30 to pass therethrough in a horizontal orientation following its sliding down bottom surface 24 upon being deposited at a can receiving region located at 32 on surface 24. As is apparent, this region may be of somewhat larger extent, however, the more elongate extent of surface 24 is selected for safety reasons whereby the operator cannot reach sufficiently far into the internal regions of apparatus 10. To prohibit the depositing of cans 30 elsewhere, i.e. upon bottom surface 26, a barrier 34 is provided which extends over opening 28 and has a height sufficient to permit the passage of cans 30 thereunder and into opening 28. The barrier 34 is so structured that it will not permit human reaching to a dangerous extent into opening 28 from along bottom surface 26 or from the top of apparatus 10. A sufficient amount of openness is provided with the arrangement, however, to permit access for cleaning. Barrier 34 is not shown in FIG. 2 in the interest of clarity, however, the screw-type attachment points coupling it to surfaces 20 and 22 are represented at 36. Shown extending from sidewall 12 of apparatus 10 is an outlet fixture 38 which communicated with the interior of the housing of apparatus 10 for purposes of disposing of liquid collected therein.

Figure 3:
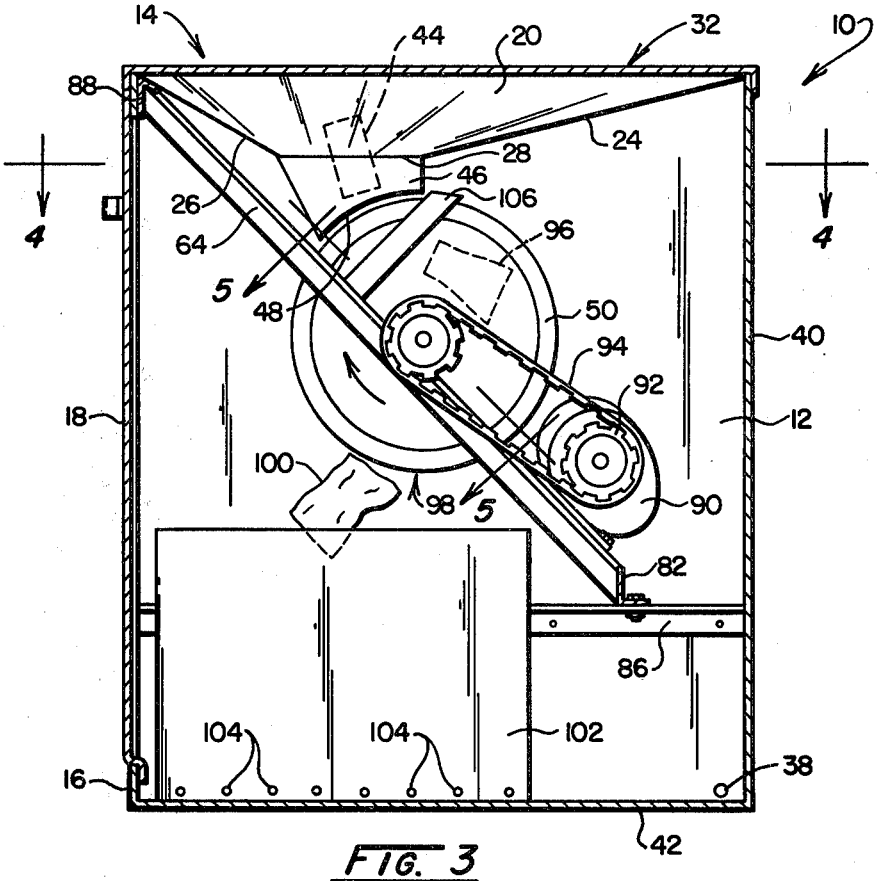
FIG. 3 is a sectional view of the apparatus of FIG. 1 taken through the plane 3—3 shown in FIG. 2.

Turning to FIG. 3, internally disposed components of the apparatus 10 are revealed. Generally, the rectangular structure of apparatus 10 is selected so that it may be built into or be positioned next to a typical counter, thus its dimensions, for example, may be selected as 18 inches wide, 24 inches in depth and 36 inches high. FIG. 3 further reveals the presence of a rear wall 40 and bottom surface 42. A can represented in phantom at 44 is shown passing through can receiving opening 28 and a downwardly directed chute 46 depending therefrom toward a wedge-shaped can receiving region represented generally at 48 and revealed in more detail in FIG. 4. Region 48 is of an extent suited for receiving cans as at 44 either in the orientation shown at 44 or in a horizontal orientation. The receiving region 48 is formed by the cooperation of two similarly structured disk members 50 and 51, the structures of which are revealed in enhanced detail in FIGS. 5 and 6. Looking additionally to those figures, disks 50–51 are shown to be configured as flat conical members having respective engaging surfaces 52 and 53. Surfaces 52 and 53 are mutually inwardly facing and formed in convex conical fashion. The slope of each of the surfaces 52 and 53 is about 9° with respect to a plane perpendicular to the axes of rotation of members 50–51. Disk 50 is shown mounted upon a drive shaft 54 which, in turn, is journaled for rotation within two pillow block bearings 56 and 58. Bearings 56 and 58 are mounted by bolts as at 60 to the upwardly disposed surface 62 of a channel-shaped strut 64 mounted within apparatus 10. Shaft 54 is coupled in driven relationship with a pulley 66.

Disk 51 is structured in identical fashion as disk 50 and is mounted upon a shaft 68 which, in turn, is journaled for rotation within pillow block bearings 70 and 72. Bearings 70 and 72, are mounted as by bolts 74 onto the upwardly disposed surface 76 of a channel spaced strut 78 (see FIG. 4). Shaft 68 is driven from drive shaft 54 by virtue of its connection therewith through a universal coupling 80.

Figure 4:
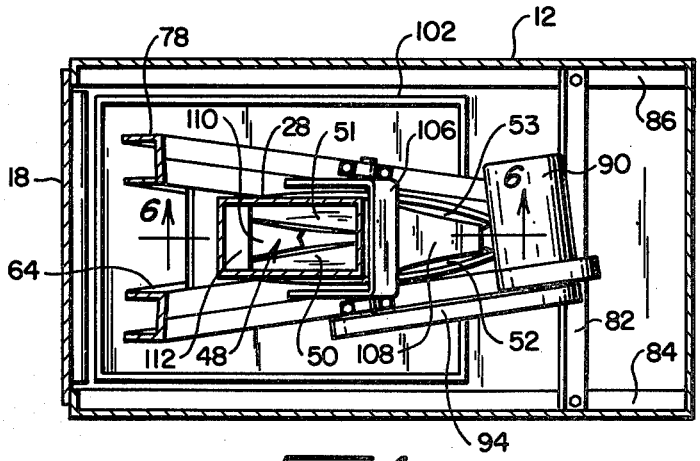
FIG. 4 is a sectional view of the apparatus of FIG. 1 taken through the plane 4—4 of FIG. 3.

Struts 64 and 78 form part of a disk support arrangement and, as revealed in FIGS. 3 and 4, they are mounted in a shallow "V" configuration within apparatus 10. In this regard, the lowermost portions of these struts are bolted to a cross member 82 which is provided as an angle piece extending across the widthwise extent of apparatus 10. Cross member 82, in turn, is bolted to horizontally disposed elongate angular supports 84 and 86. Supports 84 and 86 are fixed to sidewalls 12 and 88 as represented in FIG. 4. As revealed in FIG. 3, struts 64 and 78 extend angularly upwardly at an angle of about 45° with respect to horizontal to a cross brace 88 which is welded thereto. Brace 88, in turn, rests in abutment against the uppermost portion of front wall 16. With the arrangement, the assemblage carrying disks 50–51 may be removed for servicing by a simple removal of bolts 89.

Figure 5:
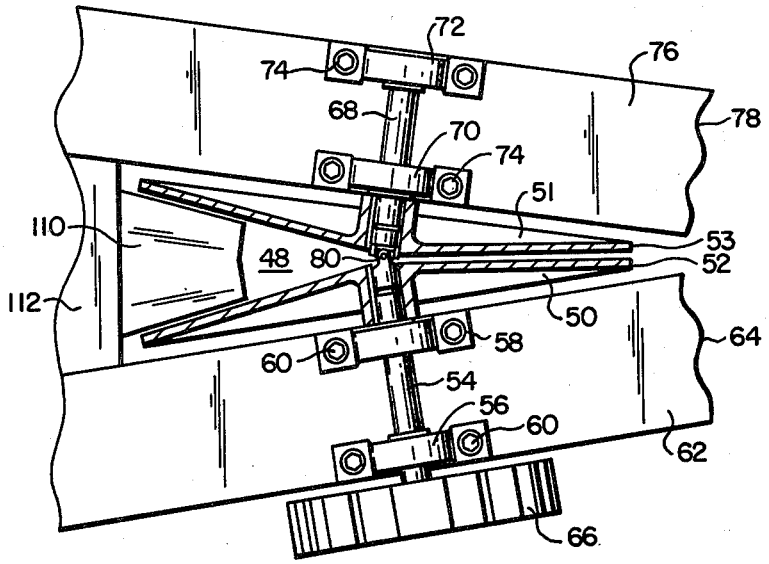
FIG. 5 is a partial sectional view of the can crushing apparatus of the invention taken through the plane 5—5 shown in FIG. 3.

FIGS. 3 and 4 further reveal that struts 64 and 78 serve to provide mounting support for an electric motor 90 having an output drive pulley 92 attached to the shaft thereof. Pulley 92, in turn, serves to impact drive to a timing belt 94 which, in turn, serves to drive pulley 66 which is attached to shaft 54 (FIG. 5). Motor 90 may be of conventional structure, one such motor being available on the market as a Dayton Gear Motor by Dayton Electric Mfg. Co., Chicago, Ill., of a ¼ horsepower rating and incorporating an output gear reduction component. Motor 90 preferably drives disks 50–51 at 60 rpm, this rate being selected for effective and yet silent operation. The direction of rotation imparted to disks 50–51 is represented in FIG. 3 by the arrow positioned on disk 50. Generally, while higher rates of rotation may be imparted to the disks 50–51, as rotational rates increase from the preferred 60 rpm, the noise of can crushing elevates.

FIG. 3 further reveals that the disk support structure including struts 64 and 78 positions the disks 50–51 in an orientation such that the earlier-described can receiving portion 48 is positioned adjacent the arcuate lower periphery of chute 46. Thus, cans as at 44 passing through chute 46 are permitted to enter region 48. Generally, region 48 will have a peripheral extent sufficient to receive a typical smaller size can in a horizontal orientation, more lengthy cans tending to turn as they pass opening 28. The procedure of crushing involves the reception of the cans as at 48 between the engaging surfaces 52 and 53 of disks 51–52 within region 48. Region 48 is that of widest extent between these disks and has an outer peripheral spacing between surfaces 52 and 53 of about 3¾ inches. This spacing has been found to be quite important and the resultant included angle between surfaces 52 and 53 within region 48 is about 33°. With such arrangement, a smaller can falling horizontally will be fully incorporated between the outer circular peripheries of disks 50–51. The crushing action imparted by disks 50–51 is one gradual in nature over an extended arcuate locus of travel as is represented by the phantom outline of a can at 96. The cans are progressively longitudinally compressed until reaching a crushed can exit location represented at 98, a can 100 being shown in the course of its expulsion from region 98. Not only is this form of crushing efficient and somewhat silent as compared to jack screw operated devices, because of the gradual crushing encountered as cans as at 96 traverse a considerable locus between disks 50–51 any beverage or liquid within the cans is gradually expelled to avoid otherwise high compressive stress build-up. A considerable mechanical advantage is achieved with the arrangement, inasmuch as in the course of arcuate movement between disks 50–51, only a gradual compression is developed until the cans as at 100 are expelled from a region 98 wherein the engaging surfaces 52–53 have a somewhat parallel orientation and a mutual spacing of about ¼ inch. The simplicity of the entire arrangement also contributes to lower costs. Note, that can 100 is shown in the course of falling into a container 102 which may be removed by access through door 18. At the bottom of container 102 there are a series of apertures 104 (FIG. 3) through which collected liquids may pass for ultimate disposal through fitting 38. Positive drive to both disk members 50–51 has been found to be of importance, inasmuch as the cans may not be "gripped" by engaging surfaces 52–54 where only one of those surfaces is driven. Only a minor amount of initial rotation, for example, of disk member 51 is required at the commencement of crushing of a can at region 48 for achieving successful start-up. The use of a universal coupling 80 has been found to provide satisfactory and reliable performance, however, other drive techniques for the disk members 50–51 will occur to those skilled in the art at hand.

Figure 6:
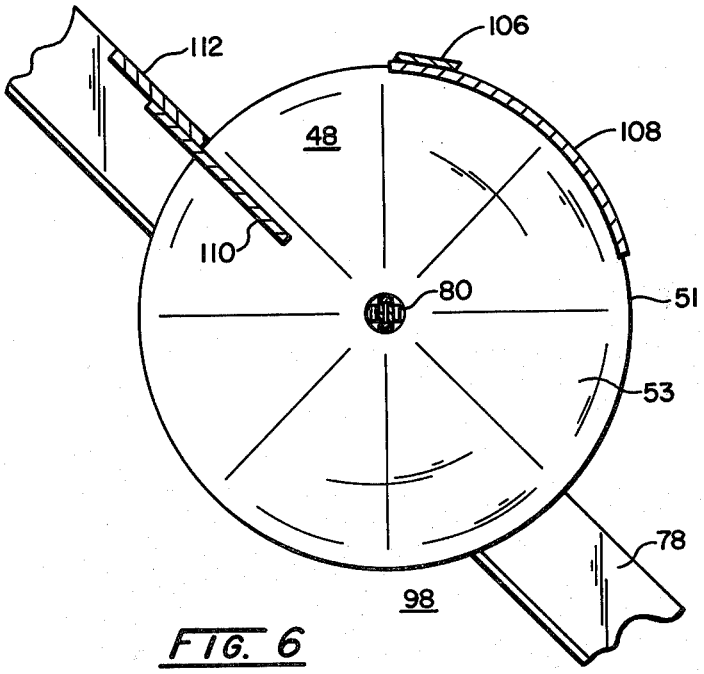
FIG. 6 is a partial sectional view of can crushing apparatus according to the invention taken through the plane 6—6 illustrated in FIG. 4.

FIG. 3 further reveals the presence of a U-shaped component 106 which is coupled to struts 64 and 78 and which extends upwardly and across the assemblage of disks 50–51. As is revealed in FIGS. 4 and 6, component 106 supports a confining member 108 which may be welded to or integrally formed therewith. Member 108 has a generally wedge-shaped configuration and extends across the top of the disk assemblage 50–51 to a point wherein the corresponding engaging surfaces thereof 52 and 53 become somewhat close. Thus arranged, confining member 108 serves to assure that cans within the crushing structure remain inside the outer periphery of disks 50–51. Similarly, the lower portion of the can receiving region 48 is provided having an input guide component 110 which is shown in FIGS. 5 and 6 to extend within input region 48 and which, is supported from a strap 112 coupled, in turn, to struts 64 and 78. Component 110 serves as guidance for cans as at 44 entering the entrance region 48, assuring that they will be engaged by surfaces 52 and 53 for progressive crushing action. With respect to the engagement of the cans by these latter surfaces 52 and 53, it further has been found desirable to provide a roughened surface texture either through the use of weldaments or through the simple expedient of providing such surfaces as part of a non-machined casting.

The selection of the angular relationships of the axes of shafts 54 and 68 as well as the slopes of surfaces 52 and 53 serves to, in turn, establish the positioning of entrance region 48 as well as exit location 98. To move exit location 98 forwardly for desired alignment, for example with container 102, it has been found that upward surfaces 62 and 76 of corresponding struts 64 and 78 may be canted such that the outwardly-disposed edges thereof are dropped slightly, for example about ¼ of an inch being typical. Such action serves to position exit location 98 more forwardly in terms of the direction of rotation of the disks 50–51.

Returning to FIG. 3, it may be observed that where the deposit of cans as at 44 is limited to the can receiving region 32, the distance from that region to entrance region 48 of disks 50–51 is extensive and contorted in direction. Thus, a typical operator reach is not sufficient to extend down the slope of bottom surface 24 and through opening 28, thence down through the distance of chute 46 to region 48. In terms of typical distances, the reach through chute 46 is about 6 inches, the distance from the bottom thereof to the dangerous portion of disk members 50–51 represents about another 8 inches and the reach from region 32 to the edge of opening 28 can be as long as about 18 inches. In effect, an inexpensive and simple technique is derived to evoke an ergometric design inherently safe for operation. As indicated earlier, the barrier 34 extends across opening 28 to prohibit access, for example, from bottom surface 26. Similarly, an operator attempting to reach into region 48 from beside apparatus 20 will encounter turning requirements which the human hand cannot carry out. Here again, the safety consideration of the simple design are highly effect. Generally, a switch is provided for actuation upon the opening of door 18 to disable the energization of motor 90. This is a typical safety procedure for such devices.

Container 102 is shown as a removable box-like structure, the container may be additionally implemented in a series of configurations, for example, a trough or funnel-like receiving receptacle which, in turn, is coupled through a duct or the like to a larger container which may be contained in a lower floor of the building in which the apparatus 10 is mounted. A variety of alternate structures will occur to those skilled in the art.

Since certain changes may be made in the above-described apparatus without departing from the scope of the invention herein, it is intended that all matter contained in the description thereof or shown in the accompanying drawings shall be interpreted as illustrative and not in a limiting sense.

I claim:

1. Can crushing apparatus comprising:

a support housing having a can receiving opening formed within a surface thereof;

first and second disk members having circular outer peripheries and each having mutually inwardly facing convex conical engaging surfaces of slope of about 9° each disk member being rotatable about a respective first and second shaft having an axis of rotation;

disk support means mounted within said housing for rotatably supporting said first and second disk members for driven rotation about said first and second axes, said first and second shafts being supported to angularly orient said axes thereof with respect to each other locating said engaging surfaces to define a wedge-shaped can receiving region accessible to said can receiving opening, and wherein the included angle between said engaging surfaces is about 33°, said engaging surfaces further defining a continuously diminishing spacing therebetween extending from said can receiving opening to a region of minimum said spacing at a crushed can exit location;

said disk support means further including an upwardly disposed confining member supported adjacent said first and second disk member outer peripheries and extending in arcuate fashion from said can receiving region toward said exit location, and an input guide component positioned beneath said can receiving region and extending intermediate said engaging surfaces for guiding cans into engagement therewith;

motor means for effecting the simultaneous, synchronized driven rotation of said first and second disk members; and collecting means an opening adjacent said crushed can exit location for receiving crushed cans.

2. The can crushing apparatus of claim 1 in which:

said disk support means supports said disks to provide a fixed spacing between said engaging surfaces at the said outer peripheries thereof at said can receiving region of about 3¾ inches.

3. The can crushing apparatus of claim 1 in which said disk support means includes:

first and second bearing means for rotatably supporting respective said first and second disk members for rotation about respective said first and second shaft axes;

frame means having first and second mutually spaced support surfaces for fixedly supporting respective said first and second bearing means, each said first and second support surfaces sloping downwardly to effect an upward inclination of respective said first and second shaft axes a predetermined amount to effect a select positioning of said crushed can exit location with respect to said collecting means.

4. The can crushing apparatus of claim 1 in which said motor means effects driven rotation of said first and second disk members at a rate of about 60 revolutions per minute.

5. The can crushing apparatus of claim 1 in which said support housing is structured having a top can feeding surface positioned above said first and second disk members, said can receiving opening is formed within said top surface and is substantially aligned with and located a predetermined spaced distance above said can receiving region, said support housing top surface being formed as an elongate trough of select length sloping downwardly from a can receiving region to said opening, the combination of said predetermined distance and said select length being greater than human reach; and barrier means attached to said support housing and extending across and above said can receiving opening for permitting human arm reach toward said can receiving opening substantially only from said can receiving region.

6. The can crushing apparatus of claim 1 in which said motor means is coupled in driving relationship with said first disk member; and said first disk member is coupled in driving relationship with said second disk member to effect said simultaneous, synchronized driven rotation.

7. Can crushing apparatus, comprising:

a housing including an upwardly disposed can feeding top surface slanting downwardly to a can receiving opening;

first and second rigid annular disk members having convex conical engaging surfaces with a slope of about 9° and mounted for driven rotation upon respective flat and second drive shafts;

disk support means mounted within said housing and including bearing means for rotatably supporting said first and second drive shafts in a mutual angular orientation selected to position said engaging surfaces in mutually inwardly facing adjacency wherein a can receiving region is defined beneath said can receiving opening having an included angle between said engaging surfaces of about 33°, said can receiving region being positioned a predetermined distance from said opening, said included angle progressively diminishing circumferentially about said disks to a crushed can exit location of substantially close adjacency of said surfaces;

motor means for effecting the simultaneous synchronized, driven rotation of said first and second disk members;

collecting means having an opening adjacent said crushed can exit location;

said housing top surface being formed as an elongate trough of select length sloping downwardly from a can receiving region to said can receiving opening, the combination of said predetermined distance and said select length being greater than human reach; and said housing including barrier means attached to said housing and extending across and above said can receiving opening for permitting human arm reach toward said can receiving opening substantially only from said can receiving region.

8. The can crushing apparatus of claim 7 in which said can receiving region has a circumferential extent of at least about 5 inches.

9. The can crushing apparatus of claim 7 in which said disk support means includes an upwardly disposed confining member extending in arcuate form from said can receiving region toward said exit location for effecting the retention of received cans intermediate said engaging surfaces.

10. The can crushing apparatus of claim 9 in which said disk support means includes an input guide component positioned beneath said can receiving region and extending intermediate said engaging surfaces for guiding cans into engagement therewith.

11. The can crushing apparatus of claim 10 in which said disk support means supports said first and second driven shafts to provide a spacing of about 3¾ inches between said engaging surfaces at said can receiving region at the peripheries of said first and second disk members.

12. The can crushing apparatus of claim 10 in which said motor means is connected in driving relationship with said first drive shaft and said first drive shaft is coupled in driving relationship with said second drive shaft.

13. The can crushing apparatus of claim 10 in which said motor means effects driven rotation of said first and second drive shafts at a rate of about 60 revolutions per minute.

* * * * *